US009586150B1

(12) United States Patent
Pamplin

(10) Patent No.: US 9,586,150 B1
(45) Date of Patent: Mar. 7, 2017

(54) STAND UP WATERSLIDE

(71) Applicant: Phillip Daniel Pamplin, Diamond Bar, CA (US)

(72) Inventor: Phillip Daniel Pamplin, Diamond Bar, CA (US)

( * ) Notice: Subject to any disclaimer, the term of this patent is extended or adjusted under 35 U.S.C. 154(b) by 0 days.

(21) Appl. No.: 15/150,160

(22) Filed: May 9, 2016

(51) Int. Cl.
*A63G 21/18* (2006.01)
*A63G 21/00* (2006.01)

(52) U.S. Cl.
CPC ..... *A63G 21/18* (2013.01)

(58) Field of Classification Search
CPC ..... A63G 21/00; A63G 21/18; A63C 19/00; A63C 19/10; A63B 69/0093
USPC ..... 472/13, 116, 117, 128, 129, 89, 90; 104/69, 70
See application file for complete search history.

(56) References Cited

U.S. PATENT DOCUMENTS 2,174,716 A * 10/1939 Bethell ..... A63C 19/10 193/2 R
4,762,316 A * 8/1988 Merino ..... A63G 21/18 441/66
5,401,214 A * 3/1995 Smollar ..... A63G 21/18 446/489
5,551,922 A * 9/1996 Katz ..... A63G 21/18 4/494
6,062,983 A * 5/2000 Butsook ..... A63G 21/18 4/488
6,312,341 B1 * 11/2001 Healy ..... A63G 21/18 472/116
2003/0073505 A1 * 4/2003 Tracy ..... B05B 17/08 472/128

* cited by examiner

*Primary Examiner* — Kien Nguyen
(74) *Attorney, Agent, or Firm* — Plager Schack LLP

(57) ABSTRACT

Some embodiments of the present disclosure include a standup water slide allowing a user to slide lengthwise down the water slide on the user's feet. The standup waterslide may include at least one panel having a pair of flat edge portions and an arched hump positioned between the pair of flat edge portions. The arched hump may include a water shaft extending lengthwise therethrough, such that both the arched hump and the water shaft extend along a length of the panel; and the arched hump may also include a plurality of spray orifices extending from the water shaft to an external surface of the arched hump. In embodiments, as many panels as desired may be interconnected to create a slide of any desired length.

8 Claims, 4 Drawing Sheets

STAND UP WATERSLIDE

BACKGROUND

The embodiments herein relate generally to entertainment activities, and more particularly, to a stand up waterslide.

Conventional waterslides and slip-n-slides are designed to be ridden in a sitting or laying position. Existing slip-n-slides can cause injuries because a rider must transition from an upright position to a plank position during the ride.

Therefore, what is needed is a waterslide that a user can ride while standing up.

SUMMARY

Some embodiments of the present disclosure include a standup water slide allowing a user to slide lengthwise down the water slide on the user's feet. The standup waterslide may include at least one panel having a pair of flat edge portions and an arched hump positioned between the pair of flat edge portions. The arched hump may include a water shaft extending lengthwise therethrough, such that both the arched hump and the water shaft extend along a length of the panel; and the arched hump may also include a plurality of spray orifices extending from the water shaft to an external surface of the arched hump. In embodiments, as many panels as desired may be interconnected to create a slide of any desired length.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
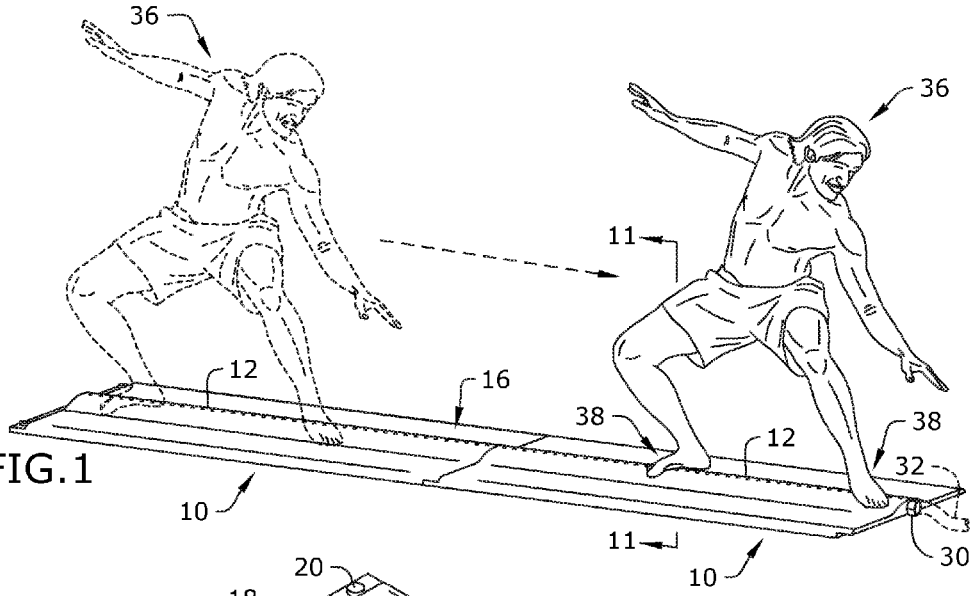
FIG. 1 is a perspective view of one embodiment of the present disclosure.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a stand up waterslide and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Slide Panel
2. Arched Hump
3. Water Channel with Water Orifices
4. Connectors The various elements of the device of the present disclosure may be related in the following exemplary fashion. It is not intended to limit the scope or nature of the relationships between the various elements and the following examples are presented as illustrative examples only.

By way of example, and referring to FIGS. 1-11, some embodiments of the present disclosure include a stand up waterslide comprising a panel 10 having a pair of flat edge portions 16 and an arched hump 12 positioned between the pair of flat edge portions 16, the arched hump 12 comprising a water shaft 26 extending lengthwise therethrough, such that both the arched hump 12 and the water shaft 26 extend along the length of the panel 10. The arched hump 12 may further comprise a plurality of spray orifices 14 extending from the water shaft 16 to an external surface of the arched hump 12 such that water flowing through the water shaft 26 may spray from the water shaft 26 through the spray orifices 14 and out of the arched hump 12 onto an external surface of the panel 10.

Figure 2:
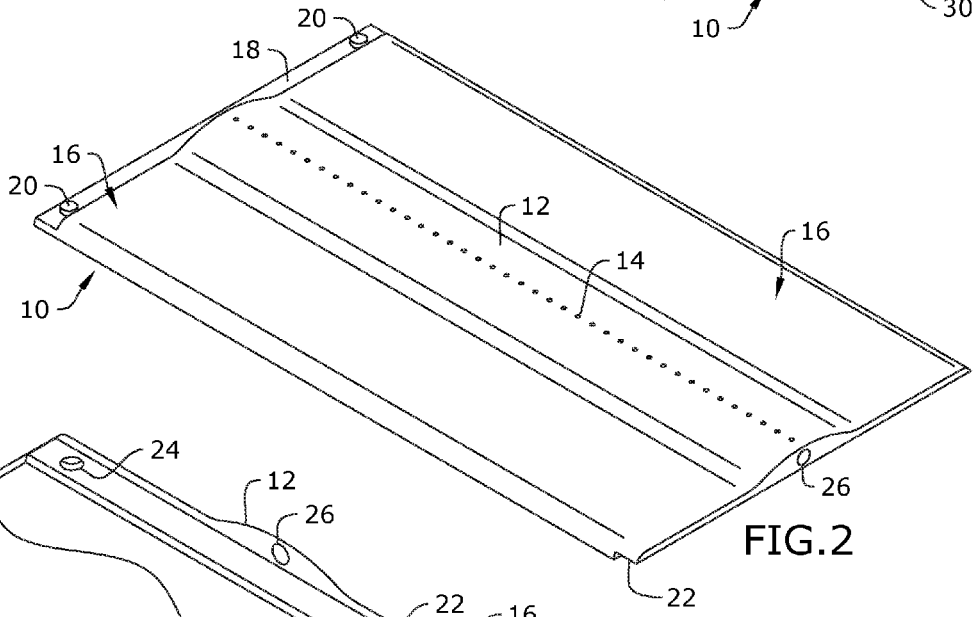
FIG. 2 is a top perspective view of one embodiment of the present disclosure.
Figure 3:
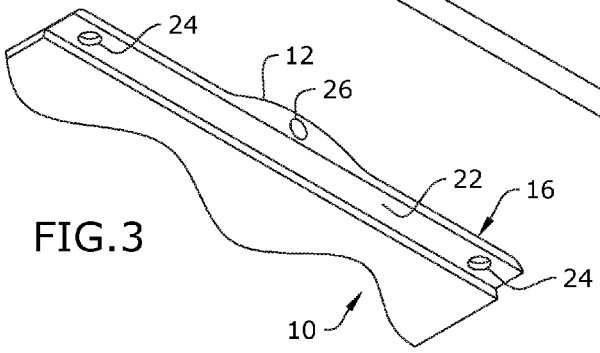
FIG. 3 is a bottom detail view of one embodiment of the present disclosure.
Figure 4:
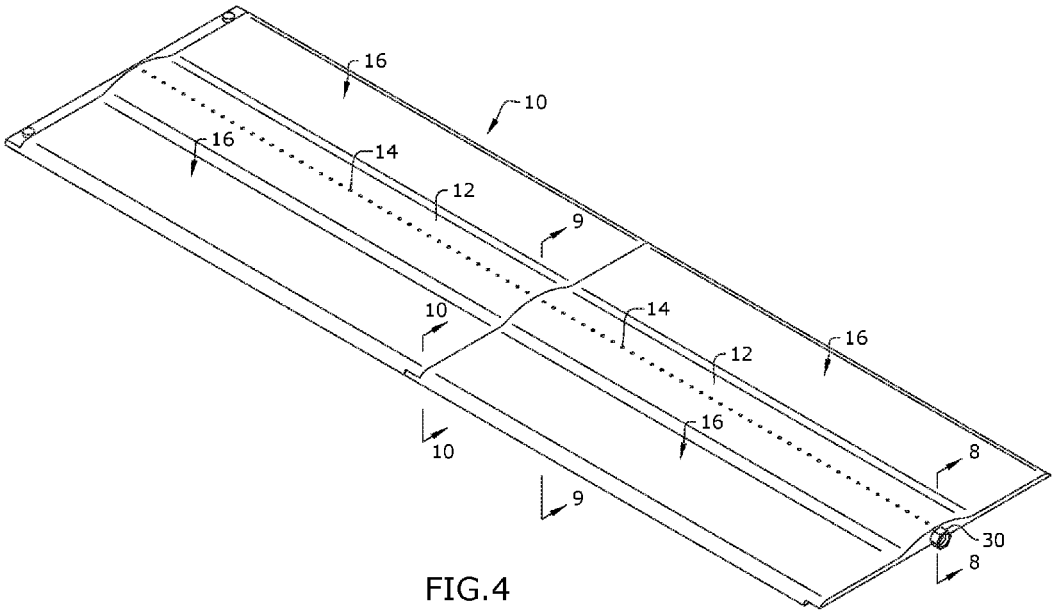
FIG. 4 is a perspective view of one embodiment of the present disclosure.

In some embodiments, each end of the panel 10 may comprise connectors for connecting a first panel to a second panel, wherein the connectors prevent the adjacent panels from separating during use. For example, as shown in the Figures, the panels 10 may each comprise a first end with an interlocking lip 18 and a second end with an interlocking notch 22, wherein an interlocking lip 18 of a first panel 10 is configured to engage with an interlocking notch 22 of a second panel 10, securing the first panel 10 to the second panel 10. In embodiments, the interlocking lip 18 may comprise at least one nub 20 extending therefrom, and the interlocking notch 22 may comprise at least one slot 24, wherein the slot 24 is configured to align with and accommodate a nub 20 from an adjacent panel 10. As shown in FIGS. 2 and 3, each panel 10 may comprise a plurality of nubs 20 and slots 24, such as a pair of nubs 20 and a pair of slots 24. While the Figures show embodiments of the standup waterslide including the interlocking lip 18 and interlocking notch 22, any suitable connectors may be used.

Figures 5, 6, 7:
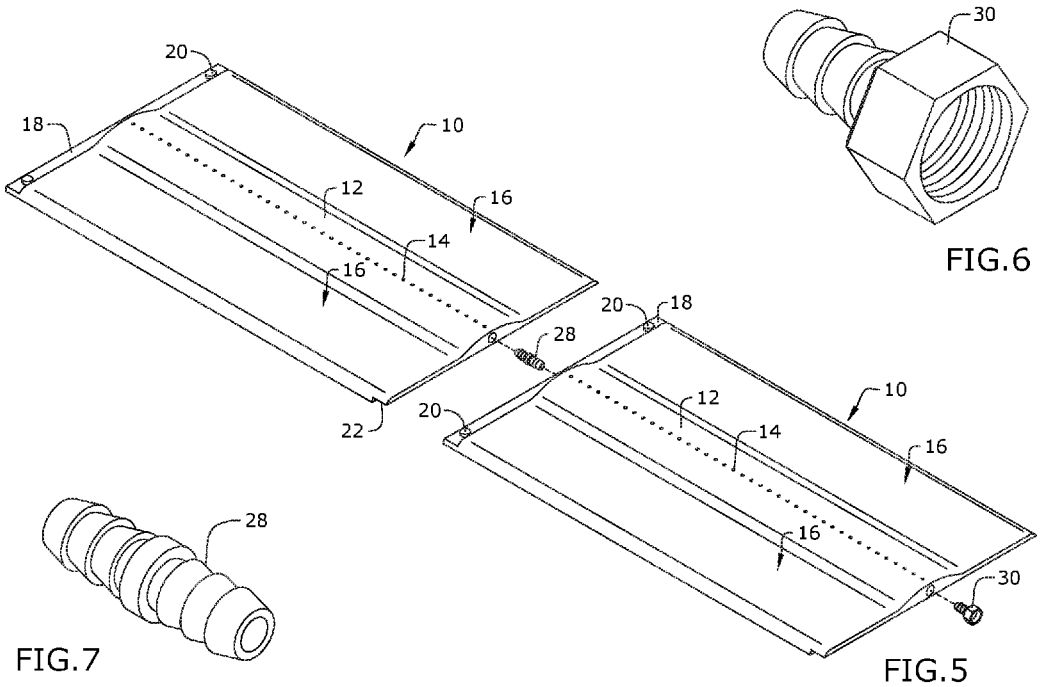
FIG. 5 is an exploded view of one embodiment of the present disclosure.
FIG. 6 is a perspective view of one embodiment of the present disclosure.
FIG. 7 is a perspective view of one embodiment of the present disclosure.
Figure 8:
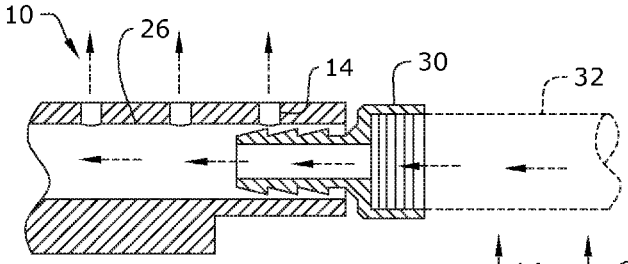
FIG. 8 is a section detail view of one embodiment of the present disclosure, taken along line 8-8 in FIG. 4.
Figure 9:
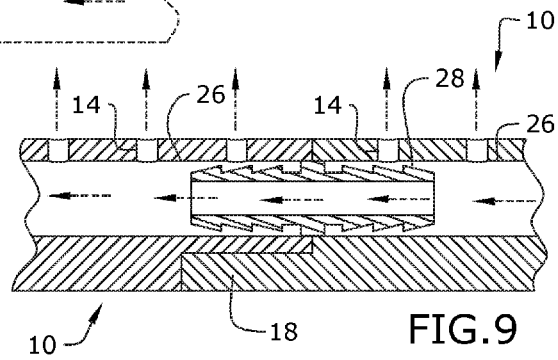
FIG. 9 is a section detail view of one embodiment of the present disclosure, taken along line 9-9 in FIG. 4.
Figure 10:
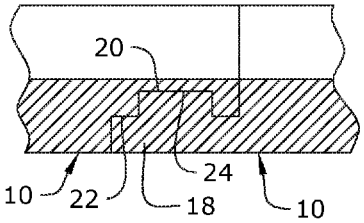
FIG. 10 is a section detail view of one embodiment of the present disclosure, taken along line 10-10 in FIG. 4.
Figure 11:
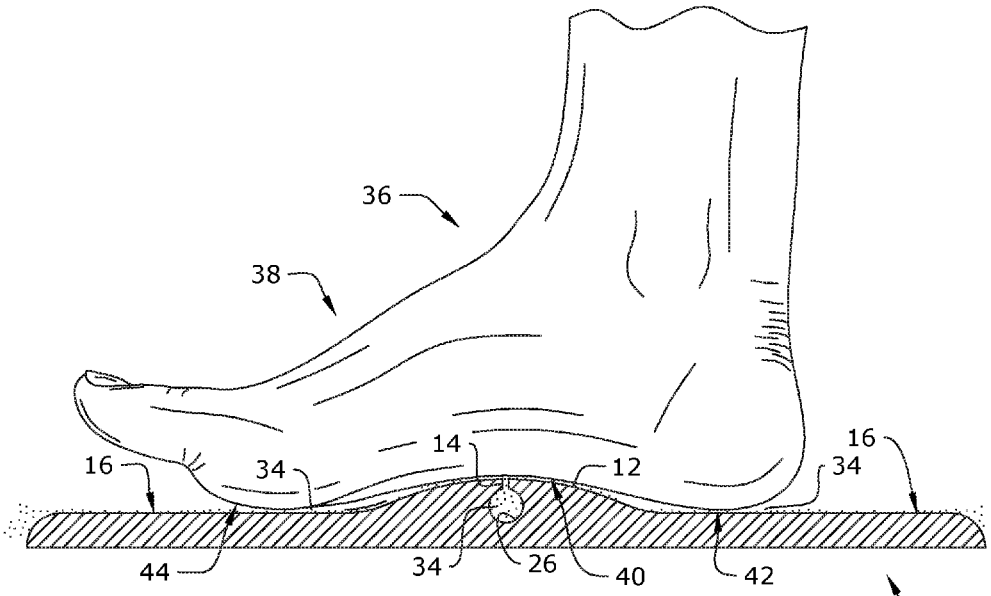
FIG. 11 is a section detail view of one embodiment of the present disclosure, taken along line 11-11 in FIG. 1.

In embodiments, when multiple panels 10 are connected, a coupler 28 may be used to attach the water shaft 26 of a first panel 10 to the water shaft 26 of a second panel 10. The coupler 28 may aid in securing the panels 10 to one another and may also help ensure that the water shafts 26 stay aligned such that water flows freely therethrough. As shown in FIG. 7, the coupler 28 may have a central portion and two ends that taper away from the central portion, wherein the tapered ends are configured to be snugly accommodated within a water shaft 26.

Embodiments of the waterslide may also comprise a hose adapter 30 removably attached to the water shaft 26 of an end panel 10. The hose adapter 30 may comprise a threaded end configured to attach to a hose and a tapered end configured to be snugly accommodated within the water shaft 26. In embodiments, the first panel 10 may be connected to a hose 32, while a last panel 10 may be plugged at the end of the water shaft 26 to force the water 32 to spray out of the spray orifices 14.

The standup water slide is configured to accommodate a user 36 sliding down the panel(s) 10 lengthwise on his or her feet 38. In embodiments, the toe region 44 and the heel region 42 of a user's foot 38 may be positioned on the flat edge portions 16 during use, while the arch region 40 of a user's foot 38 may be positioned on the arched hump 12. Thus, at least the arched hump 12 may have a strength and rigidity sufficient to accommodate a user's weight without collapsing.

To use the waterslide of the present disclosure, a user may use a single panel 10 or attach as many panels 10 as desired in a row, creating a slide of any desired length. The user may then attach a hose 32 or other water source to the water shaft 26 by, for example, the hose adapter 30. Water 34 (or any other desired liquid) may thus flow from the hose 32 into the water shaft 26 and along the length of the slide. Some of the water 32 may spray out of the spray orifices 14 to moisten the external surface of each panel 10. The user may then slide down the waterslide on his or her feet, as shown in FIG. 1.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A standup water slide allowing a user to slide lengthwise down the water slide on the user's feet, the standup water slide comprising:

a panel comprising a pair of flat edge portions and an arched hump positioned between the pair of flat edge portions, wherein:

the arched hump comprises a water shaft extending lengthwise therethrough, such that both the arched hump and the water shaft extend along a length of the panel; and the arched hump further comprises a plurality of spray orifices extending from the water shaft to an external surface of the arched hump.

2. The standup waterslide of claim 1, wherein each end of the panel comprises connectors for connecting a first panel to a second panel.

3. The standup waterslide of claim 2, wherein:

the panel comprises a first end with an interlocking lip and a second end with an interlocking notch;

the interlocking lip of a first panel is configured to engage with the interlocking notch of a second panel.

4. The standup waterslide of claim 3, wherein:

the interlocking lip comprises at least one nub extending therefrom; and the interlocking notch comprises at least one slot;

the at least one slot is configured to align with and accommodate the at least one nub from an adjacent panel.

5. The standup waterslide of claim 4, wherein each panel comprises a pair of nubs and a pair of slots.

6. The standup waterslide of claim 1 further comprising a second panel configured to attach to the panel.

7. The standup waterslide of claim 1, further comprising a coupler attaching the water shaft of the panel to a water shaft of the second panel.

8. The standup waterslide of claim 1, further comprising a hose adapter attached to the water shaft.

* * * * *